US005956797A

United States Patent [19]

Wilson

[11] Patent Number: 5,956,797

[45] Date of Patent: Sep. 28, 1999

[54] TOOTHBRUSH DEVICE

[76] Inventor: Vernon C. Wilson, 20 Branch Brook Dr., Belleville, N.J. 07109

[21] Appl. No.: 09/013,835

[22] Filed: Jan. 27, 1998

Related U.S. Application Data

[63] Continuation-in-part of application No. 08/743,814, Nov. 6, 1996, abandoned.

[51] Int. Cl.[6] ..... A46B 9/04

[52] U.S. Cl. ..... 15/167.1; 15/172

[58] Field of Search ..... 15/167.1, 167.2, 15/172, 201

[56] References Cited

U.S. PATENT DOCUMENTS

| | | | |
|---|---|---|---|
| 1,369,664 | 2/1921 | Izawa | 15/167.1 |
| 1,894,509 | 1/1933 | Booth | 15/167.1 |
| 2,266,195 | 12/1941 | Hallock | 15/167.1 |
| 2,685,703 | 8/1954 | Dellenbach | 15/167.1 |
| 3,065,479 | 11/1962 | McGee | 15/167.1 |
| 3,398,421 | 8/1968 | Rashbaum | 15/167.1 |
| 4,317,463 | 3/1982 | Massetti | 15/167.2 |
| 4,333,199 | 6/1982 | Del Rosario | 15/167.1 |
| 4,691,405 | 9/1987 | Reed | 15/167.1 |
| 5,758,383 | 6/1998 | Hohlbein | 15/167.1 |

*Primary Examiner*—Terrence R. Till
*Attorney, Agent, or Firm*—LaMorte & Associates

[57] ABSTRACT

A toothbrush device that conforms to the curvature and contours of the teeth while brushing. The toothbrush device includes a handle for gripping. At least one bristle head is disposed a predetermined distance from the handle. A support mechanism is disposed between the handle and each of the bristle heads. The support mechanism varies the predetermined distance between the bristle heads and the handle as a function of a contact force applied to each of the bristle heads. A connection is disposed between each support mechanism and each bristle head. The presence of the connection enables each bristle head to move in at least one plane in a manner independent of the support mechanism. This provides each of the bristle heads with the freedom of movement needed to properly conform to the curvature and contours of the teeth.

17 Claims, 7 Drawing Sheets

TOOTHBRUSH DEVICE

RELATED APPLICATIONS

This application is a Continuation-In-Part of U.S. patent application Ser. No. 08/743,814, filed Nov. 6, 1996 and entitled Anatomically Adjustable Toothbrush System, now abandoned.

DOCUMENT DISCLOSURE DOCUMENTS

The parent application cited above claims benefit of the date of a first Document Disclosure Document No. 364815.

This application claims the benefit of the filing date of both the parent application and a second Document Disclosure Document No. 397088.

BACKGROUND OF THE INVENTION

1. Field of the Invention

The present invention relates to toothbrushes that have a bristle head that is able to move independently of the toothbrush handle, thereby enabling the bristle head to better conform to the contours of the teeth during brushing.

2. Prior Art Statement

The prior art is replete with different types and styles of toothbrushes that are used to brush the teeth and maintain proper oral hygiene. One of the most common types of toothbrush designs utilizes a single head of bristles that is permanently affixed in a set orientation at the end of a handle. Although the handle may have the ability to flex slightly, the movement of the bristle head directly corresponds to the movement of the handle.

As is commonly known, most teeth are not flat, even, nor do they lay in a straight line. Rather, individual teeth are curved. Different teeth are different sizes and have different contours. Adjacent teeth do not always align. Rather, teeth are often crooked with different teeth leaning in different directions. Lastly, teeth are set into the bones of the skull and jaw along generally semicircular paths. At different points along a row of teeth, the radius of curvature changes, depending upon the size of the mouth, the number of teeth and the orientation of the teeth. The area within the mouth with the smallest radius of curvature is typically the area on the tongue side of the teeth behind the central and lateral incisors.

Utilizing a traditional toothbrush where the bristle head is set in one position, it is nearly impossible to manipulate the bristle head properly to cause the bristle head to brush against all surfaces of the teeth. Recognizing the flaws in the design of traditional toothbrushes, alternative designs have been produced. The purpose of the alternative designs is to increase contact between the bristle head and the teeth, thereby increasing the efficiency of the brushing action.

U.S. Pat. No. 5,228,166 to Gomez, entitled Removable Pivotable Head Toothbrush, exemplifies prior art toothbrush devices that have a bristle head that is pivotably connected to the toothbrush handle. In such prior art designs, the bristle head is able to pivot in line with the handle. This helps the bristle head better move across the teeth. One of the problems associated with such prior art toothbrush designs is that the single large bristle head prevents the bristles from conforming to the teeth on areas where the position of the teeth curve sharply. Furthermore, the single plane of movement provided by the pivot does not assist the bristle head in conforming to crooked teeth or teeth that do not otherwise conform to the vertical.

U.S. Pat. No. 5,398,366 to Bradley, entitled Rocker Toothbrush, exemplifies toothbrush designs where the bristle heads are pivoted to move in planes that are perpendicular to the line of the toothbrush handle. A problem associated with such tooth brush designs is that the pivoting movement of the bristle heads do not help the bristle conform to the teeth in areas having a small radius of curvature, such as behind the lateral and central incisors.

U.S. Pat. No. 5,499,421 to Brice, entitled Twin-Headed Toothbrush exemplifies prior art toothbrush designs where different bristle heads are supported by different elements that extend from the handle. In such tooth brush designs, the bristle heads are side-by-side. Accordingly, the bristle heads have the same difficulty in conforming to areas of the teeth with small radii of curvature as do tradition toothbrushes with single set bristle heads.

A need therefore exists in the prior art for a toothbrush design that is capable of having bristle heads conform to the teeth in areas where the teeth are arranged with a small radius of curvature and in situations where the teeth may be of different sizes and misaligned. This need is met by the present invention as described and claimed below.

SUMMARY OF THE INVENTION

The present invention is a toothbrush device that conforms to the curvatures and contours of the teeth while brushing. The toothbrush device includes a handle for gripping. At least one bristle head is disposed a predetermined distance from the handle. A support mechanism is disposed between the handle and each of the bristle heads. The support mechanism varies the predetermined distance between the bristle heads and the handle as a function of a contact force applied to each of the bristle heads. A connection is disposed between each support mechanism and each bristle head. The presence of the connection enables each bristle head to move in at least one plane in a manner independent of the support mechanism. This provides each of the bristle heads with the freedom of movement needed to properly conform to the curvature and contours of the teeth.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention device can be used in conjunction with any brush system, such as cleaning brushes and the like, the present invention device is especially suitable for use in the field of toothbrushes. As a result, the exemplary embodiments of the present invention device will all illustrate the present invention device configured as a toothbrush in order to set forth the best mode contemplated for the invention.

Figure 1:
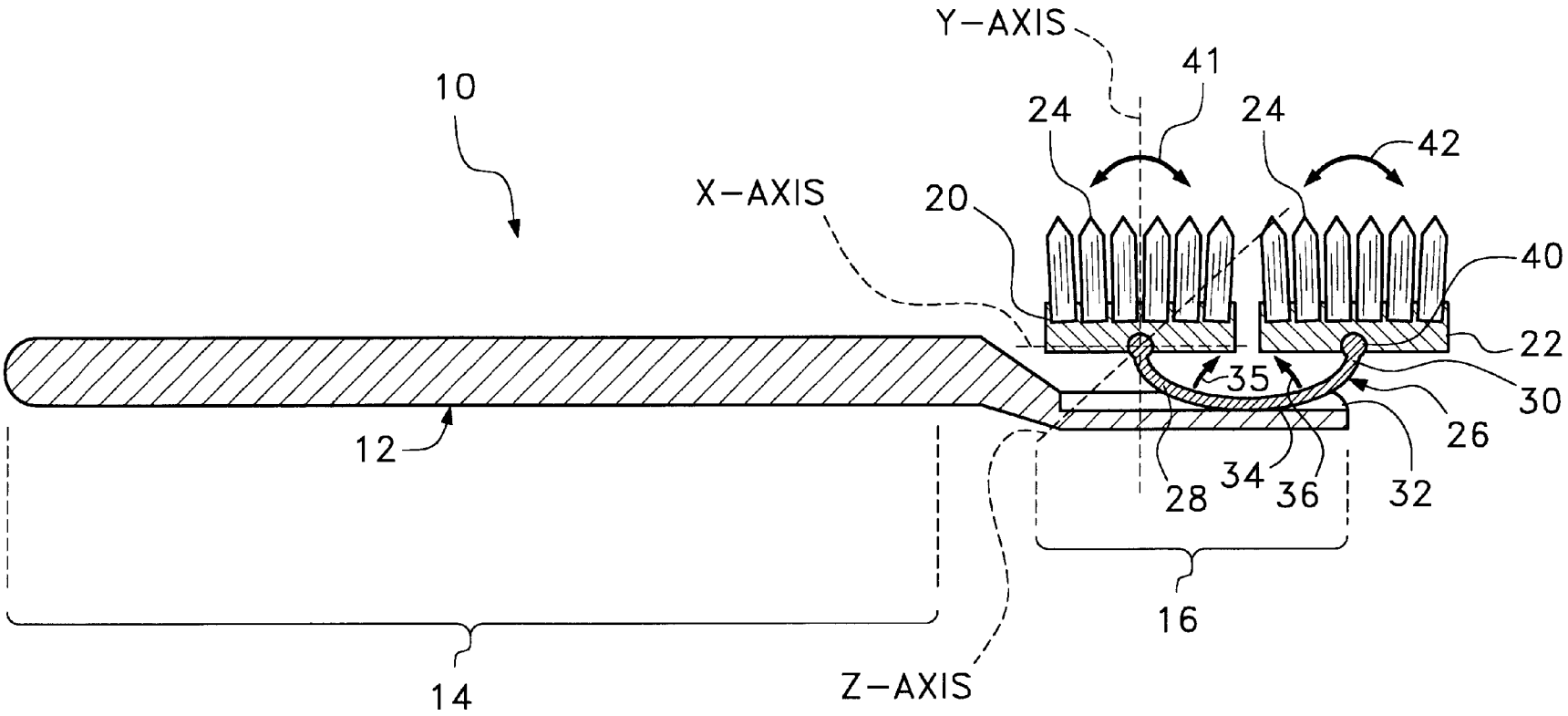
FIG. 1 is a cross-sectional view of an exemplary toothbrush device in accordance with the present invention.

Referring to FIG. 1, an exemplary embodiment of a toothbrush device 10 is shown in accordance with the present invention. The toothbrush device 10 includes a handle 12. In the shown embodiment, the handle 12 includes an elongated gripable section 14 and a head support section 16. Although the gripable section 14 and the head support section 16 of the handle 12 can each be linearly aligned, in the shown embodiment the head support section 16 is positioned slightly off-center from the longitudinal axis of the gripable section 14.

The toothbrush device 10 includes a plurality of bristle heads. In FIG. 1, two bristle heads 20, 22 are shown by way of example. Each of the bristle heads 20, 22 supports a matrix of bristles 24 that extend from each bristle head 20, 22. The bristles 24 can have many different configurations and may terminate in a common plane or in a contoured configuration. Different bristle patterns and contours are well known in the prior art.

An arm support 26 is disposed between the head support section 16 of the handle 12 and the bristle heads 20, 22. The arm support 26 is a generally U-shaped structure having a first arm element 28 and a second arm element 30 that extend upwardly. The first shown bristle head 20 is connected to the first arm element 28. Similarly, the second shown bristle head 22 is connected to the second arm element 26.

A slot 32 is disposed in the head support section 16 of the handle 12 below the bristle heads 20, 22. The bottom center of the arm support 26 is connected to the head support section 16 of the handle 12 with a pivot 34 within the slot. Consequently, both the first arm element 28 and the second arm element 30 are free to rotate about the pivot 34 in the directions of arrows 35 and 36, within the confines of the slot 32. The axis of the pivot 34 is perpendicular to the longitudinal axis of the slot 32 and the head support section 16 of the handle 12.

As the arm support 26 rotates about the pivot 34, the height of the top end of both the first arm element 28 and the second arm element 30 changes with respect to the handle 12. At least part of an articulated coupling 40 is disposed at the top end of each arm element 28, 30. The articulated coupling 40 interconnects the each arm element 28, 30 to the corresponding bristle head 20, 22. In FIG. 1, a reference guide of an X, Y and Z axis is shown. The origin of the reference guide should be considered at the top end of each arm element 28, 30. An articulated coupling 40 is any coupling that would enable the bristle heads 20, 22 to at least partially rotate about the X-axis, the Y-axis and the Z-axis. In the shown embodiment, the articulated coupling 40 is a ball and socket joint, wherein the ball is disposed at the top end of each arm element 28, 30 and the socket is disposed in the bottom of each bristle head 20, 22. In alternative embodiments, hinge arrangements can be used. Similarly, a segment of elastomeric material or a spring element can also be positioned between the arm elements 28, 30 and bristle heads 20, 22, wherein the elastomeric material or spring acts as the articulated coupling by allowing deformation in all directions.

Figure 3:
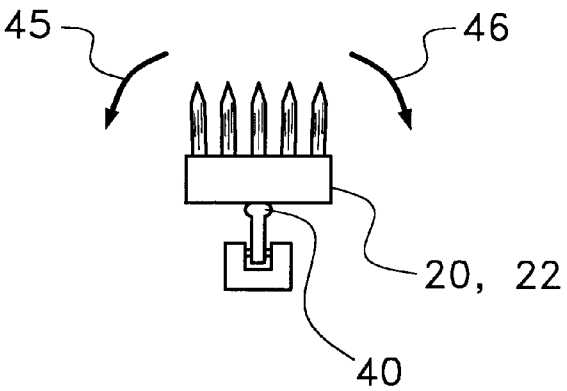
FIG. 3 is a end side view of the bristle head section of the embodiment of the toothbrush device shown in FIG. 1.
Figure 2:
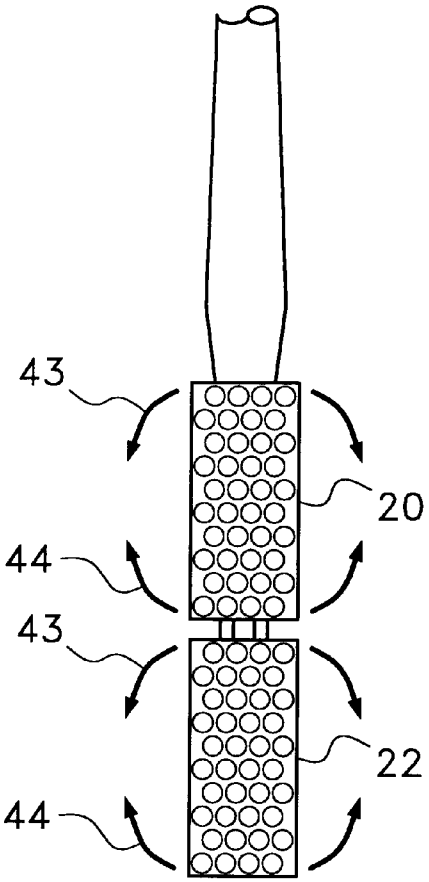
FIG. 2 is a top view of the bristle head section of the embodiment of the toothbrush device shown in FIG. 1.

From FIG. 1, it is clear that the arm elements 28, 30 enable each of the bristle heads 20, 22 to move in the directions of arrows 41 and 42, respectively. Referring now to FIG. 2, it can be seen that the articulated coupling 40 (FIG. 1) between each arm element 28, 30 (FIG. 1) and each bristle head 20, 22 enables the bristle heads 20, 22 to rotate about the point of the articulated coupling on the directions of arrows 43 and 44, respectively. Similarly, by referring to FIG. 3, it can be seen that the articulated coupling 40 between each arm element and each bristle head 20, 22 enables the bristle heads 20, 22 to rotate about the point of the articulated coupling 40 in the directions of arrows 45 and 46, respectively.

Returning to FIG. 1, it should therefore be understood that the arm elements 28, 30 enable the bristle heads 20, 22 to move independently up and down in the Y-axis. Simultaneously, the articulated coupling 40 between the arm elements 28, 30 and the bristle heads 20, 22 enable the bristle heads 20, 22 to pitch, roll and yaw about the X-axis, the Y-axis and the Z-axis, respectively.

Figure 4:
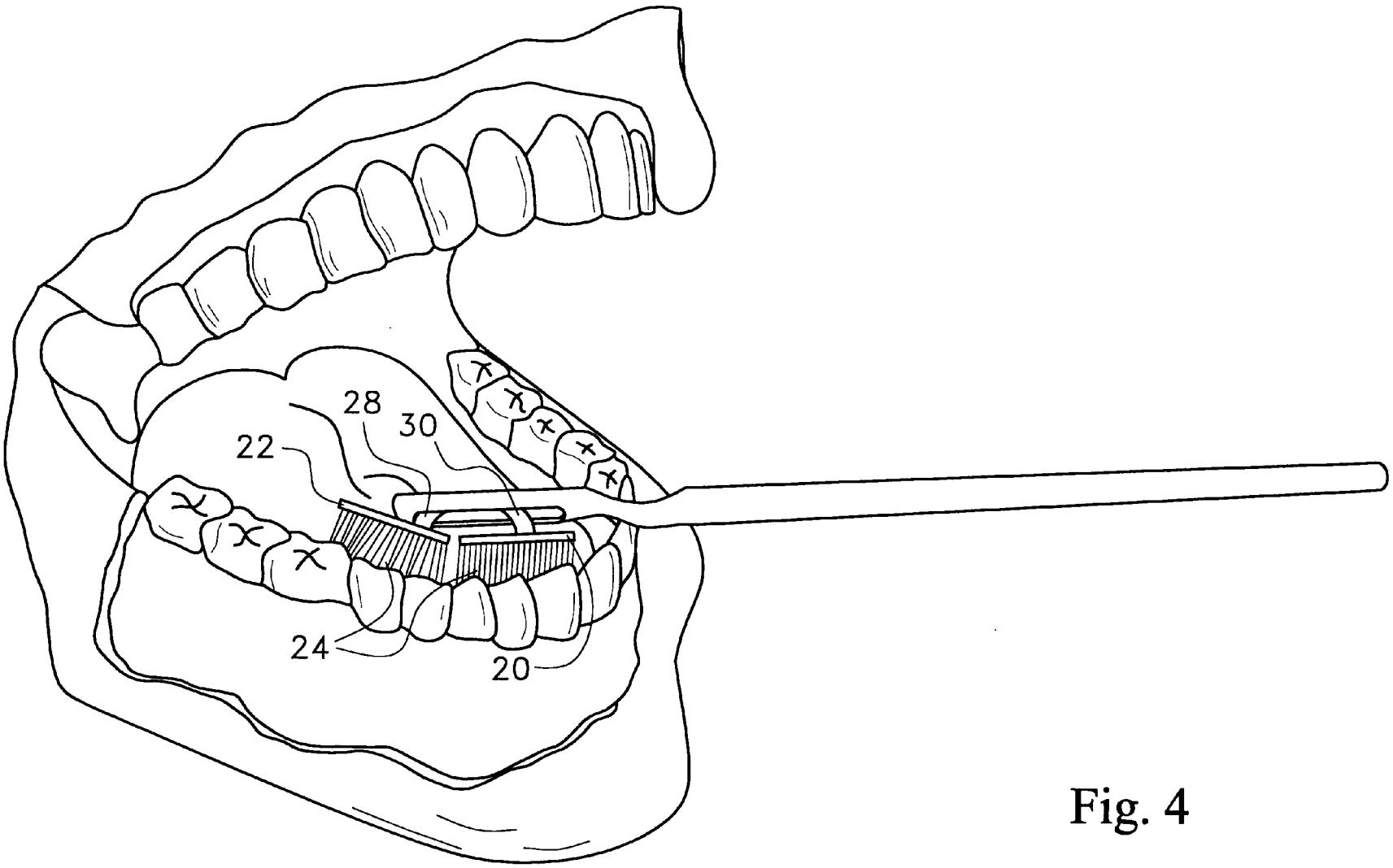
FIG. 4 is a perspective view of the embodiment of the toothbrush device shown in FIG. 1, shown in conjunction with a fragmented mouth to expose the teeth within the mouth.

Referring to FIG. 4, it can be seen that the multiple degrees of freedom in motion provided to the bristle heads 20, 22 by the arm elements 28, 30 and the articulated coupling 40 enable the bristle heads 20, 22 to conform to the contour of the mouth even in areas having a small radius of curvature. This enables the bristles 24 to maintain good contact with the teeth regardless to the position or orientation of the teeth in the mouth.

In the embodiment of FIGS. 1–4, the bristle heads 20, 22 were connected to the arm elements 28, 30 by a ball and socket joint. It will be understood that such a joint can be made with a snap fit, wherein the bristle heads 20, 22 can be selectively separated from the arm elements 28, 30. The ability to selectively connect and disconnect the bristle heads 20, 22 enable the bristle heads 20, 22 to be easily replaced when worn without having to replace the remainder of the toothbrush device 10.

Figure 5:
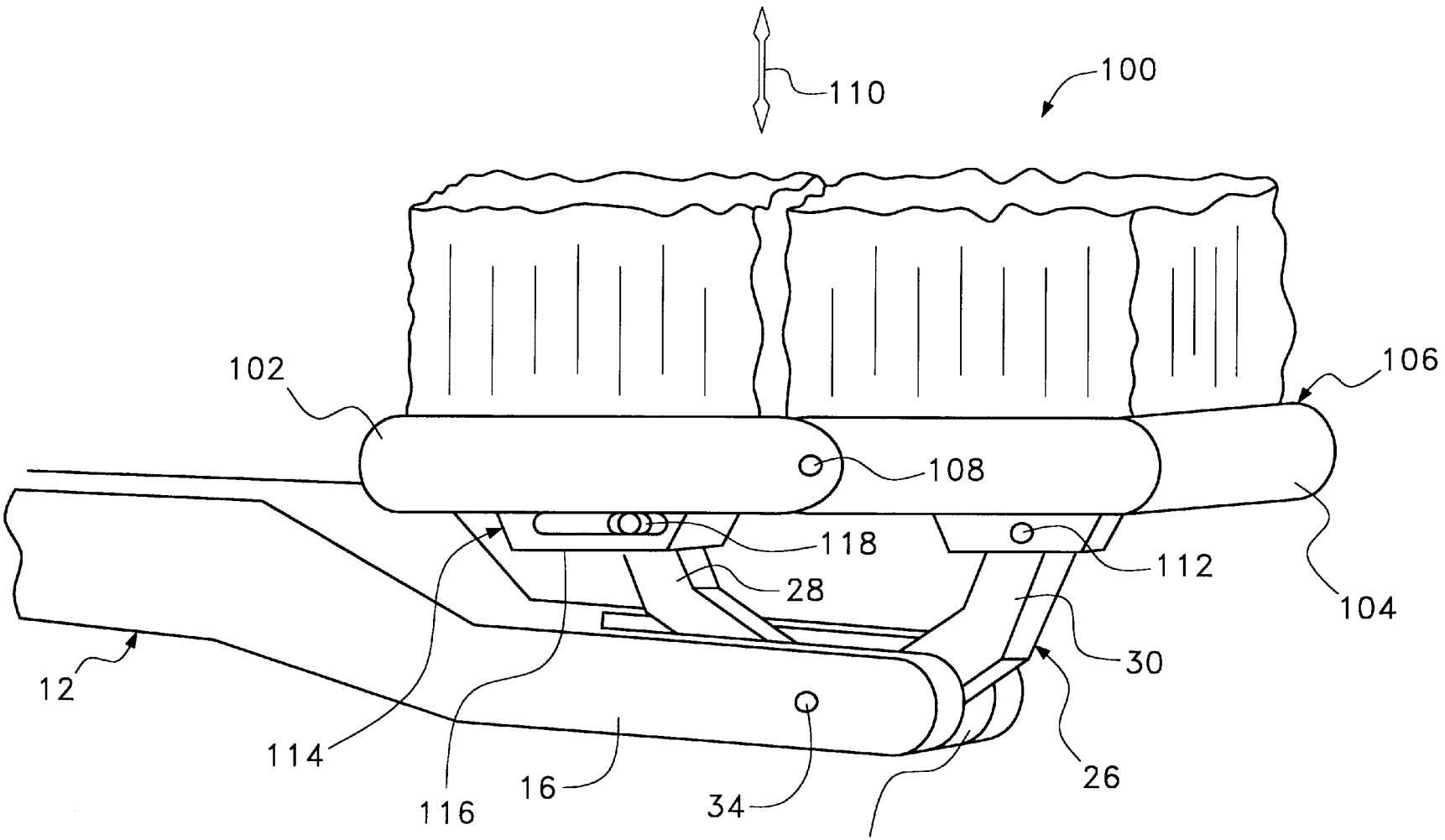
FIG. 5 is a perspective view of the bristle head section of an alternate embodiment of a toothbrush device in accordance with the present invention.

Referring to FIG. 5, an alternate embodiment of a toothbrush device 100 is shown in accordance with the present invention. In this embodiment, the head support section of the handle 16, the slot 32, the arm support 26, arm elements 28, 30 and the pivot connection 34 between the head support region 16 and the arm support 26 are the same as with the initial embodiment. For this reason, the elements are identified with the same reference numerals as were used with the initial embodiment.

In the embodiment of FIG. 5, the two bristle heads 102, 104 are joined together at one end to create an overall bristle head assembly 106. In the embodiment shown, a hinge connection 108 is used to join the two bristle heads 102, 104. However, it will be understood that other connections can be used such as an elastomeric material joint or a thinned flexible plastic joint. Regardless of the connection used, it should be understood that the center of the bristle head assembly 106 is free to move up and down in the directions of arrow 110, thereby selectively changing the slope associated with each of the bristle heads 102, 104.

The top ends of the arm elements 28, 30 below the bristle heads 102, 104 no longer terminate with fully articulated connections. Rather, in the embodiment of FIG. 5, less free interconnection elements are used. As is shown, the top end of the second arm element 30 is pivotably connected to the bottom of the second bristle head 104. This enables the second bristle head 104 to turn about the pivot connection 112 in the same plane as length of the toothbrush handle 12. However, since the second bristle head 104 is pivotably connected to the first bristle head 102, any movement in the second bristle head 104 will cause movement in the first bristle head 102.

The arm elements 28, 30 enable each of the bristle heads 102, 104 to move up and down independently of the other. Accordingly, each side of the bristle head assembly 106 can move up and down independently. In order to allow for the two bristle heads 102, 104 to move up and down independently and for the second bristle head 104 to pivot about the top of the second arm element 30, the interconnection between the first arm element 28 and the first bristle head 102 can not be laterally static. Rather, in the shown embodiment, the top end of the first arm element 28 connects to the center of the first bristle head 102 with a sliding pivot arrangement 114. The sliding pivot arrangement 114 includes a slotted track 116. A pivot pin 118 rides within the slotted track 116, wherein the pivot pin 118 is attached to the top of the first arm element 28.

The use of the arm elements 28, 30 as well as the pivot connections between the bristle head assembly 106 and the arm elements 28, 30, enable the bristle head assembly 106 to conform to either a concave orientation or a convex orientation. In either orientation, the radius of curvature to which the bristle heads 102, 104 conform can be varied within a wide range. Once in a particular radius of curvature, the entire bristle head assembly 106 can rotate about the pivot 34 of the arm support 26. Accordingly, the bristle head assembly 106 can be configured to either the outside of the teeth or the inside of the teeth and can be moved along the teeth while maintaining contact between the bristles and the teeth.

Figure 6:
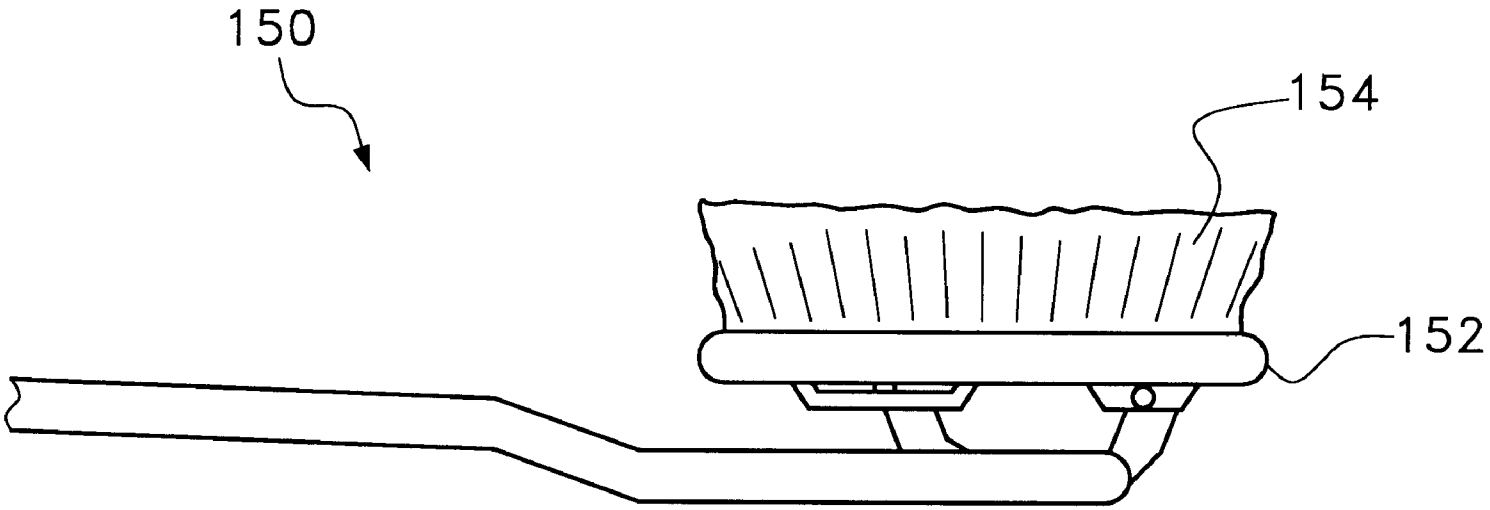
FIG. 6 is a side view of a second alternative embodiment of a toothbrush device in accordance with the present invention.

Referring to FIG. 6. a slight modification of the toothbrush device of FIG. 5 is shown. In this embodiment, separate bristle heads are not used. Rather, the toothbrush device 150 has a single bristle head 152 fabricated from an elastomeric material. The bristles 154 are set into the material of the bristle head 152. Since the bristle head 152 is made from elastomeric material, the bristle head 152 is free to bend across its entire length. Accordingly, the bristle head 152 can conform to curved surfaces better than can rigid bristle heads. The flexible bristle head 152 can be attached to the handle utilizing and support and connector assembly previously of subsequently described.

Figure 7:
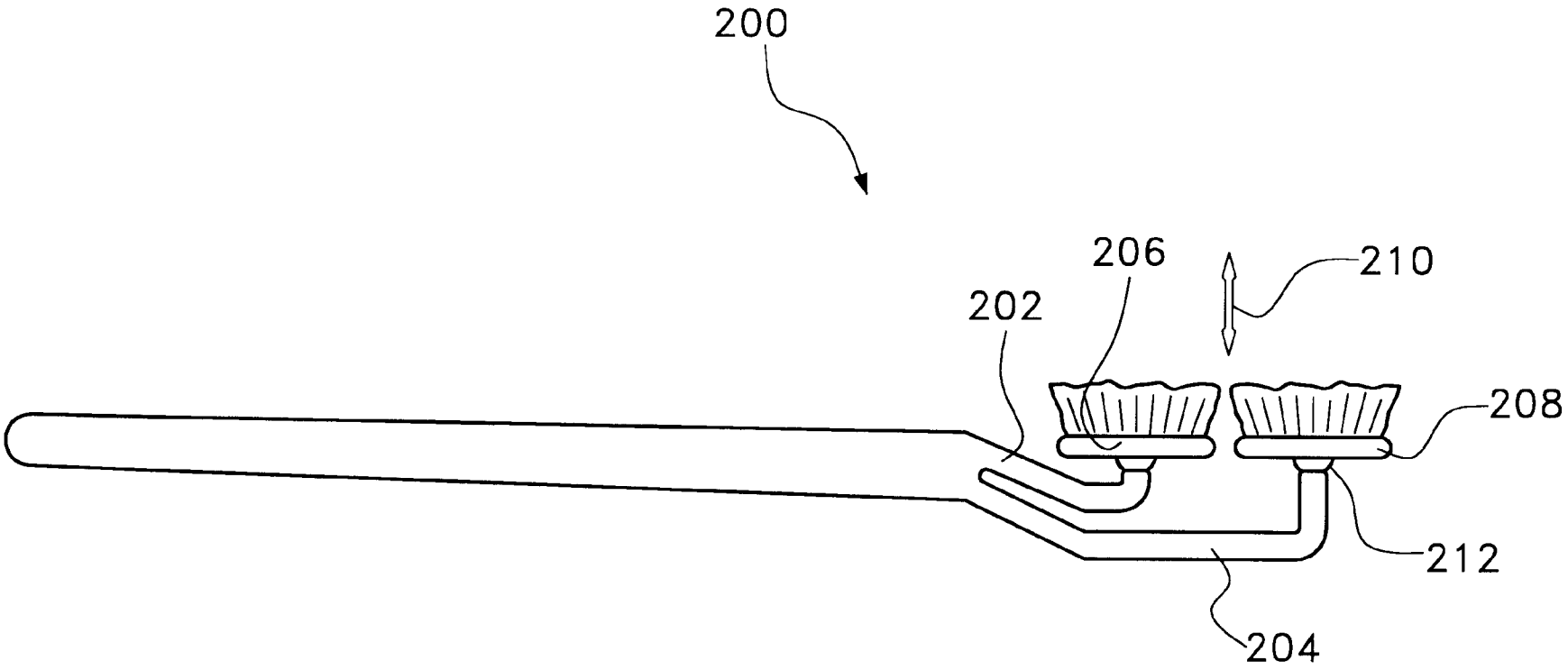
FIG. 7 is a side view of a third alternative embodiment of a toothbrush device in accordance with the present invention.

Referring to FIG. 7, a third alternative embodiment of a toothbrush device 200 is shown in accordance with the present invention. In this embodiment, the two flexible arms 202, 204 are used to support the two bristle heads 206, 208. The arms 202, 204 are flexible and enable the two bristle heads 206, 208 to move independently up and down in the directions of arrow 210 and back and forth in the plane of the paper. The flexible arms 202, 204 can connect to the bristle heads 206, 208 with articulated connections 212 as is shown and was previously described. Alternatively, the arms can connect to the bristle heads with the pivot connections illustrated and described in connection with FIG. 5.

Figure 8:
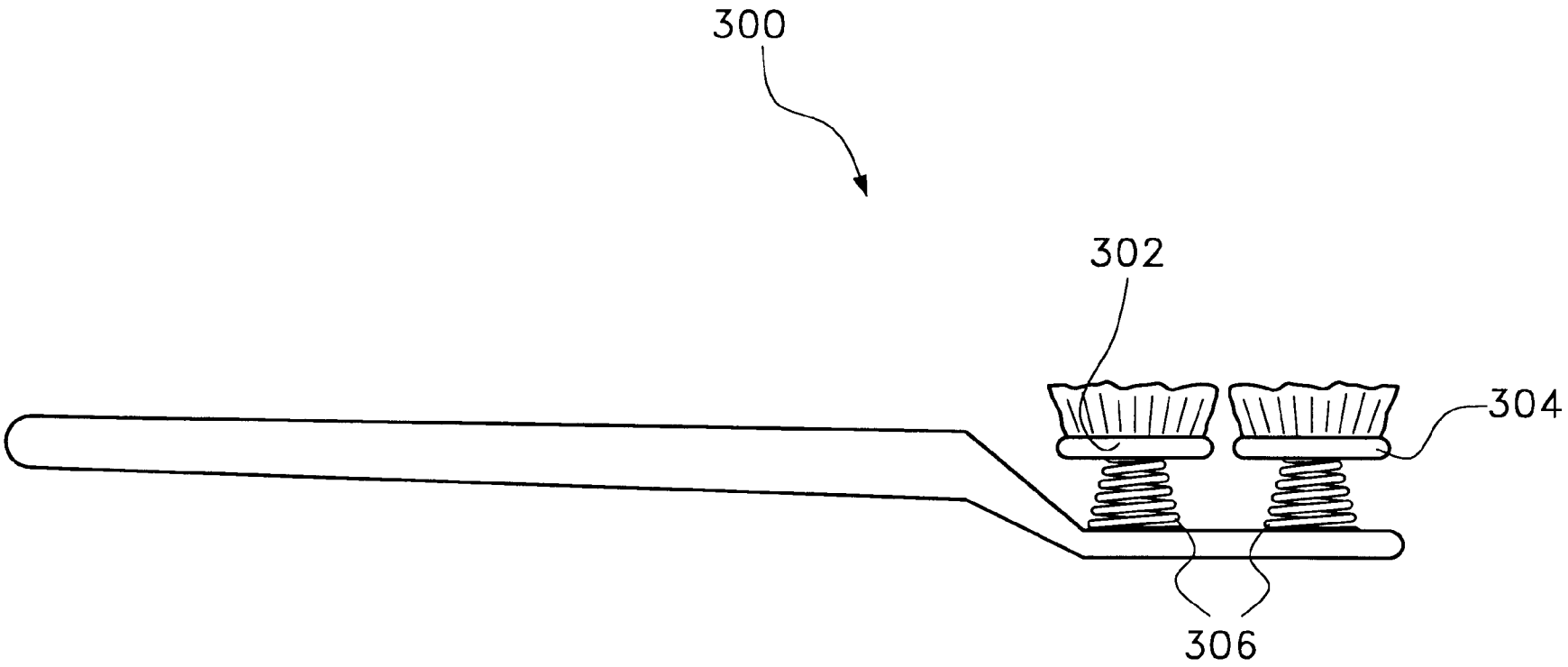
FIG. 8 is a side view of a fourth alternative embodiment of a toothbrush device in accordance with the present invention.

Referring to FIG. 8, a fourth alternate embodiment of a toothbrush device 300 is shown. In this embodiment, the two bristle heads 302, 304 are supported by spring elements 306. The spring elements 306 allow the bristle heads to move independently up and down. Furthermore, the spring elements 306 enable each of the bristle heads 302, 304 to independently pitch, roll and yaw in order to conform to the shape and contour of a person's teeth. Accordingly, the spring element take the place of flexible arm supports with articulated connections.

It will be understood that the embodiments of the present invention described and illustrated herein are merely exemplary and a person skilled in the art can make many variations to the embodiment shown without departing from the scope of the present invention. It should also be understood that the various elements from the different embodiments shown can be mixed together to create alternate embodiments that are not specifically described. All such variations, modifications and alternate embodiments are intended to be included within the scope of the present invention as defined by the appended claims.

What is claimed is:

1. A toothbrush device, comprising:

a handle;

a first bristle head and a second bristle head disposed a predetermined distance from said handle, wherein said first bristle head and said second bristle head each have two short sides and two long sides and said first bristle head and said second bristle head are linearly aligned with the short side of each facing the other;

a support mechanism disposed between said handle and both said first bristle head and said second bristle head for varying said predetermined distance as a function of a contact force applied to said first bristle head and said second bristle head; and a connection disposed between said support mechanism and both said first bristle head and said second bristle head, that enables said first bristle head and said second bristle head to move in at least one plane independent of said support mechanism.

2. The device according to claim 1, wherein said first bristle head and said second bristle head are interconnected by at least one flexible connection.

3. The device according to claim 1, wherein said support mechanism includes at least one arm element pivotably connected to said handle.

4. The device according to claim 1, wherein said support mechanism includes a first spring element that interconnects said first bristle head to said handle and a second spring element that interconnects said second bristle head to said handle.

5. The device according to claim 1, wherein said connection is a pivoted connection.

6. The device according to claim 1, wherein said connection is a ball and socket joint.

7. The device according to claim 1, wherein said support arm includes a first arm element that supports said first bristle head and a second arm element that supports said second bristle head.

8. The device according to claim 7, wherein said first arm element and said second arm element are interconnected and join to said handle at a common pivot point.

9. The device according to claim 7 wherein said connection between said first arm element and said first bristle head is a sliding pivot connection and said connection between said second arm element and said second bristle head is a pivot connection.

10. The device according to claim 7, wherein said first arm element and said second arm element are flexible and extend from said handle.

11. The device according to claim 1, wherein said at least one bristle head is flexible.

12. A toothbrush device, comprising:

a handle;

a bristle head assembly having a first bristle head coupled to second bristle head with a pivotable connection, wherein a slope associated with each said first bristle head and said second bristle head can be independently varied;

an arm support having a first end, a second end and a middle section disposed between said first end and said second end, wherein said first end is coupled to said first bristle head, said second end is coupled to said second bristle head and said middle section is pivotable connected to said handle.

13. The device according to claim 12, wherein said second end of said arm support is pivotably connected to said second bristle head.

14. The device according to claim 13, wherein said first end of said arm support is coupled to said first bristle head with sliding pivot arrangement.

15. A toothbrush device, comprising:

a handle;

a plurality of bristle heads;

a plurality of flexible arms extending from said handle, wherein each of said plurality of flexible arms supports one of said bristle heads;

a connector disposed between each of said flexible arms and each of said bristle heads that enable each of said bristle heads to move in at least one plane independently of a flexible arm in support thereof.

16. The device according to claim 15, wherein said connector includes a ball and socket joint.

17. A toothbrush device, comprising:

a handle;

at least one bristle head disposed a predetermined distance from said handle, wherein said at least one bristle head is flexible;

a support mechanism disposed between said handle and said at least one bristle head for varying said predetermined distance as a function of a contact force applied to said at least one bristle head; and a connection disposed between said support mechanism and each said at least one bristle head that enables said at least one bristle head to move in at least one plane independent of said support mechanism.

* * * * *